US006637332B1

(12) United States Patent
Takami

(10) Patent No.: US 6,637,332 B1
(45) **Date of Patent: *Oct. 28, 2003**

(54) STAMP UNIT

(75) Inventor: Hiroshi Takami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/684,397

(22) Filed: Oct. 10, 2000

Related U.S. Application Data

(62) Division of application No. 09/277,844, filed on Mar. 29, 1999, now Pat. No. 6,164,202.

(30) Foreign Application Priority Data

Mar. 31, 1998 (JP) ..... 10-85967

(51) Int. Cl.[7] ..... B41K 1/42
(52) U.S. Cl. ..... 101/405; 101/327
(58) Field of Search ..... 101/405, 327, 101/333, 368, 379, 103, 109, 125

(56) References Cited

U.S. PATENT DOCUMENTS

| | | | | |
|---|---|---|---|---|
| 3,998,312 A | | 12/1976 | Fujimi et al. | 197/55 |
| 4,676,162 A | * | 6/1987 | Phipps et al. | 101/405 |
| 5,111,745 A | | 5/1992 | Wilson | 101/333 |
| 5,483,880 A | | 1/1996 | Seo et al. | 101/125 |
| 5,595,112 A | * | 1/1997 | Seo | 101/126 |
| 5,839,367 A | | 11/1998 | Hashimoto | 101/316 |
| 5,957,053 A | * | 9/1999 | Hayama | 101/401.1 |
| 6,016,749 A | * | 1/2000 | Tukahara et al. | 101/401.1 |

FOREIGN PATENT DOCUMENTS

| | | |
|---|---|---|
| EP | 0 659 577 A1 | 6/1995 |
| EP | 0 798 114 A2 | 10/1997 |
| EP | 0 826 507 A1 | 3/1998 |
| JP | A-9-249983 | 9/1997 |

* cited by examiner

*Primary Examiner*—Andrew H. Hirshfeld
*Assistant Examiner*—Annthony H. Nguyen
(74) *Attorney, Agent, or Firm*—Oliff & Berridge, PLC

(57) ABSTRACT

A stamp unit 1 comprises a holder 4 which is to be set in a holder storage part 70 of a stamp manufacturing device for making a stamping surface on a stamp material 3 held in the holder 4. When the holder 4 is set in the storage part 70, the cam effect is generated between the positioning projection 77 of a fixing member 71 and a slant recess 43 of the holder 4, thereby positioning the holder 4 to a predetermined stamp making position in the storage part 70. In a state where the holder 4 is positioned in place, microswitches 75A and others disposed near the projection 77 of the storage part 70 are selectively turned on and off by cooperation between detection recesses 44 and a peripheral wall 38 of the holder 4, so that the existence and the type (size) of the holder 4 are detected.

5 Claims, 11 Drawing Sheets

STAMP UNIT

This is a Division of application Ser. No. 09/277,844 filed Mar. 29, 1999 now U.S. Pat. No. 6,164,202. The entire disclosure of the prior application(s) is hereby incorporated by reference herein in its entirety.

BACKGROUND OF THE INVENTION

1. Field of the Invention

The present invention relates to a stamp unit provided with a holder which is vertically slidably disposed in a skirt member and retains a stamp material in the lower side and a grip member which is disposed above the holder and moves it downward, and more particularly to a stamp unit capable of readily and surely setting a holder to a predetermined position in a storage part of a stamp manufacturing device for making a stamp from a stamp material held in the holder, and capable of correctly detecting the existence and the type of the holder set to the predetermined position in the storage part.

2. Description of Related Art

Conventionally, the stamp unit of various types has been proposed. Focusing attention on a manufacturing process of a stamp to be used in the stamp unit, one type of the stamp unit is disclosed in Japanese patent application No. Hei 9-249983 which was filed by the present applicant. This stamp unit comprises a grip, a holder, and a skirt member. The holder is connected with the grip so that the holder is vertically movable within the skirt member, and a stamp forming material is disposed in a lower side of the holder.

In the stamp unit, the stamp forming material has a two-layer configuration comprised of an upper layer made of porous hard resin and a lower layer made of porous soft resin in which optical energy absorbing material, such as carbon black, etc., is dispersed. To produce this stamp forming material by means of a stamp manufacturing device, at first, while a part of rolled-up transparent film is drawn out and fed from the roll, characters and figures are printed on the film to form a positive manuscript. This positive manuscript is then brought onto a transparent acrylic plate. Subsequently, the stamp unit integrally constituted of the holder, the grip, and the skirt member is set to a predetermined position in the stamp manufacturing device so that the lower layer of the stamp forming material faces to the manuscript. In such the state, when a xenon tube disposed below the transparent acrylic plate is driven to emit light, the lower layer of the stamp forming material is irradiated with the light through the positive manuscript. The part of the lower layer irradiated with light at sites corresponding to the transparent portion of the manuscript is then fused due to heating effect of the optical absorbing material of the lower layer, and solidified. On the other hand, the part of the lower layer corresponding to the characters and the like on the manuscript is not fused-solidified and remains as it is, thus forming a stamping surface on a lower face of the stamp forming material. To print characters and the like with the stamp unit, the stamping surface of the stamp forming material is applied with ink from the outside such that the ink is saturated into the stamp forming material from the non-fused-solidified portion of the stamping surface, forming characters and the like, and the stamp unit is placed at a desired position on a printing sheet. Upon push of the grip of the stamp unit, the ink saturated in the stamp forming material is caused to ooze through the non-fused-solidified portion onto the printing sheet, and the ink adheres thereto, printing the desired characters and the like.

Meanwhile, the prior art stamp unit is set to a predetermined position in the stamp manufacturing device by engaging a projection formed on the stamp unit with a cutout formed in a stamp making part of the device. For detection of the size of the stamp unit, there is provided a slid volume mounted on an angular C-letter-shaped member in an open/close door. Using the slide volume of which electrical resistance varies as the position of the open/close door, the output of the current from the slide volume is detected, whereby to detect the size of the stamp unit.

The projection of the stamp unit and the cutout of the stamp making part are configured to have less play therebetween and to inherently correspond to each other in shape. To position the stamp unit at a predetermined position by the engagement between the projection and the cutout as mentioned above, the projection has to be properly fitted in the cutout. However, such the proper engagement between the projection and the cutout requires a long time. Unless the proper engagement between the projection and the cutout, the electrical resistance of the slid volume will not correspond to the stamp unit size. Consequently, there may occur a problem of error-detection of the stamp unit size.

To make a lower surface of the stamp forming material disposed below the holder into a stamping surface, the whole stamp unit that is integrally formed of the holder, the grip, and the skirt member is set in the stamp manufacturing device. For this purpose, the stamp manufacturing device needs providing a storage part in which the whole stamp unit can be held and also the space in which other members are to be mounted. Accordingly, the stamp manufacturing device will inevitably become large in size, thereby causing the increase of cost.

For providing a correct and complete stamping surface on a lower surface of the stamp forming material, the stamp unit has to be precisely set to a predetermined position in the stamp manufacturing device. Such the setting of the stamp unit in the stamp manufacturing device requires to provide a projection serving as a positioning mark for the stamp unit. Since the skirt member of the stamp unit is exposed to the outside of the stamp manufacturing device, the positioning projection formed on the skirt member may spoil the appearance of the entire stamp unit, or demerits in design remarkably appear. In this regard, for example, the holder being disposed inside of the skirt member is invisible from the outside, so that there is no problem if the positioning projection serving as a positioning reference or mark is provided to the holder.

SUMMARY OF THE INVENTION

The present invention has been made in view of the above circumstances and has an object to overcome the above problems and to provide a stamp unit capable of readily and surely setting a holder to a predetermined position in a storage part of a stamp manufacturing device to produce a stamp from a stamp material held in the holder, and capable of accurately detecting the existence of the holder in the storage part when the holder is set to the predetermined position, as well as the type of the holder.

It is another object of the present invention to provide a stamp unit which is reduced in cost due to a compact-sized stamp manufacturing device.

It is another object of the present invention to provide a stamp unit of which a stamping surface can be produced in a state where the holder holds a stamp material therein, so that a positioning portion may be formed on the holder, not on a skirt member, thus maintaining the appearance of the stamp unit.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a stamp unit comprising a skirt member, a holder member disposed vertically slidably in the skirt member, a stamp member held at a lower end of the holder member, and a grip member disposed above the holder member, for moving the holder member downward, wherein the stamp unit is set in a stamp manufacturing device while the holder member holds the stamp member and, after manufacture of a stamp from the stamp member by means of the stamp manufacturing device, the holder member is then disposed slidably in the skirt member, the stamp unit further comprising a storage part for holding the holder member, the storage part being provided in the stamp manufacturing device, a positioning projection formed on one side of the storage part, a detection switch for detecting existence and type of the holder member, the detection switch including at least two switches disposed close to the positioning projection in the storage part, a positioning recess formed on a side wall of the holder member, the recess having sloped surfaces which provide a cam effect in cooperation with the positioning projection, and positioning the holder member in the storage part due to the cam effect, and activation and inactivation sections lo formed in the holder member close to the positioning recess, the sections causing the detection switches to selectively turn on or off in a state that the holder member is positioned in the storage part by cooperation between the positioning projection and the positioning recess.

In the above stamp unit, when the holder is set in the stamp manufacturing device, a cam effect is generated between the positioning projection formed on one side of the storage part of the stamp manufacturing device and the positioning recess formed on the side wall of the holder. The positioning projection is guided in the recess due to the cam effect, so that the holder is positioned in the storage part by cooperation between the projection and the recess. In this manner, when the holder is positioned in the storage part by cooperation of the projection and the recess, the detection switch disposed adjacent to the projection of the storage part is selectively turned on and off through the activation and inactivation sections provided near the positioning recess of the holder. According to the selective ON/OFF state of the detection switch, the existence and the type of the holder used in the stamp unit are detected.

Accordingly, even if the holder is placed in the storage part of the stamp manufacturing device, the positioning projection is guided in the positioning recess due to the cam effect. This enables the simple and reliable setting of the holder to a predetermined position in the storage part. With the holder set to the predetermined position, the detection switch is selectively turned on and off through the activation and inactivation sections provided near the positioning recess of the holder. This makes it possible to accurately detect the existence and the type of the holder used in the stamp unit.

Since the holder having the stamp material is set in the stamp manufacturing device to produce a stamping surface, the stamp manufacturing device can be reduced in size as compared with the case where the whole stamp unit is set in the stamp manufacturing device. In addition, the stamping surface is formed on the stamp material held in the holder, so that the positioning portion can be formed on the holder and not the skirt member. The holder being disposed inside of the skirt member is invisible from the outside and thus maintains the appearance of the stamp unit.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
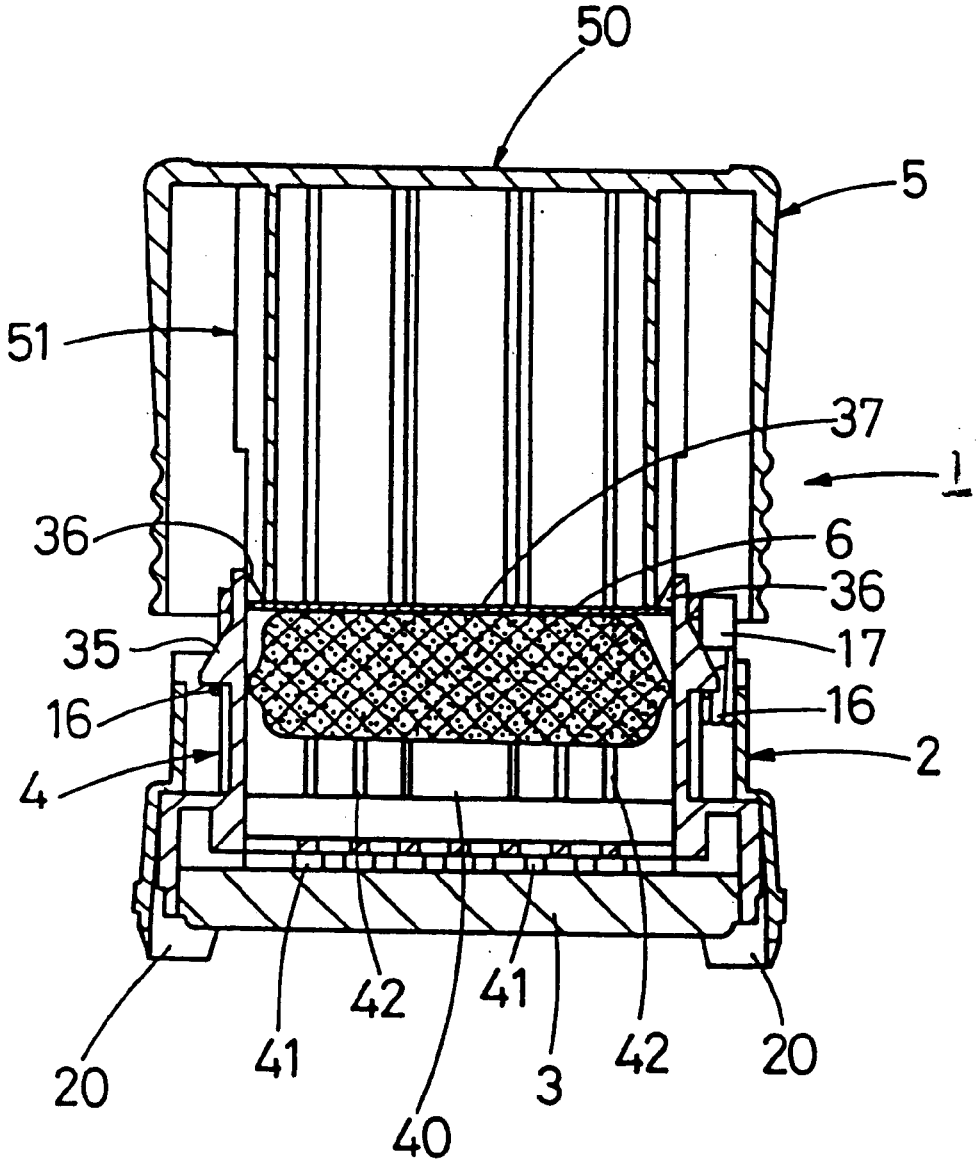
FIG. 1 is a cross sectional view of a stamp unit before ink supply in an embodiment according to the present invention.

A detailed description of a preferred embodiment of a stamp unit embodying the present invention will now be given referring to the accompanying drawings. At first, the structure of the stamp unit in the embodiment is explained with reference to FIG. 1. FIG. 1 is a cross sectional view of the stamp unit before ink supply.

In FIG. 1, a stamp unit 1 is mainly constituted of a skirt member 2 for supporting the whole stamp unit 1 during a stamping operation, a holder 4 which is disposed slidably in a vertical direction within the skirt member 2 and holds a stamp material 3 in the lower side, a grip member 5 which is joined with the holder 4 such that the holder 4 is moved down during stamping thereby to press the stamp material 3 against a printing sheet not shown, and an ink pack 6 which is formed of a pack made of film material, filled up with ink, and disposed in the holder 4. For the film material of the ink pack 6, a selected one from polyethylene, polypropylene, polyester, nylon, etc. or two kinds sheet-like materials bonded together is used.

Figure 2:
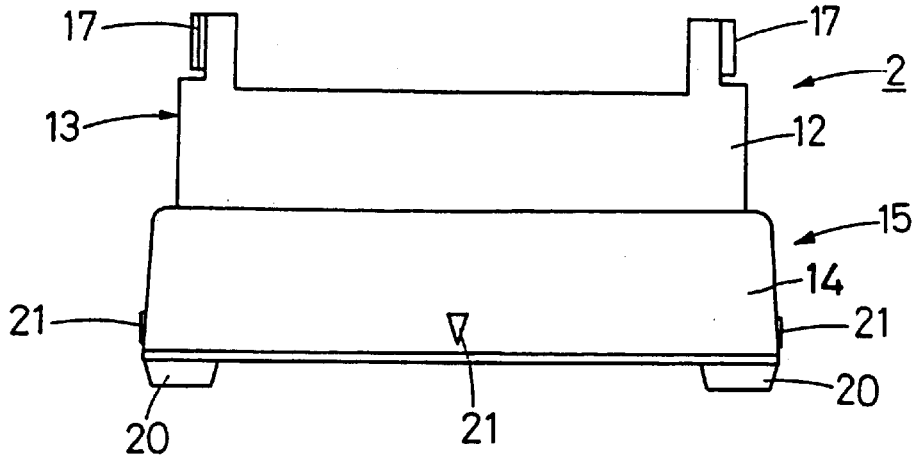
FIG. 2 is a side view of a skirt member in the embodiment.
Figure 3:
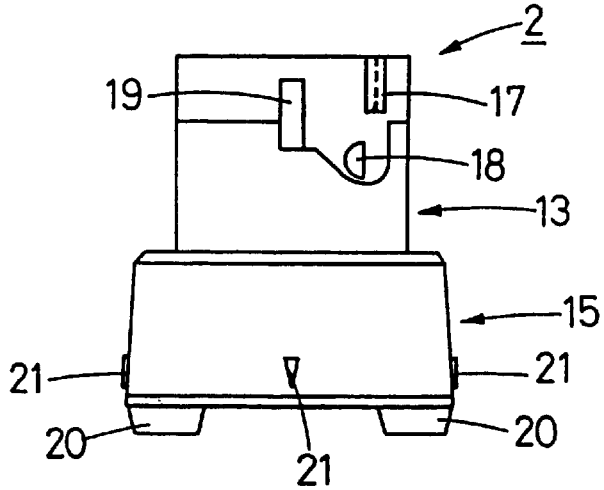
FIG. 3 is an end face view of the skirt member.
Figure 4:
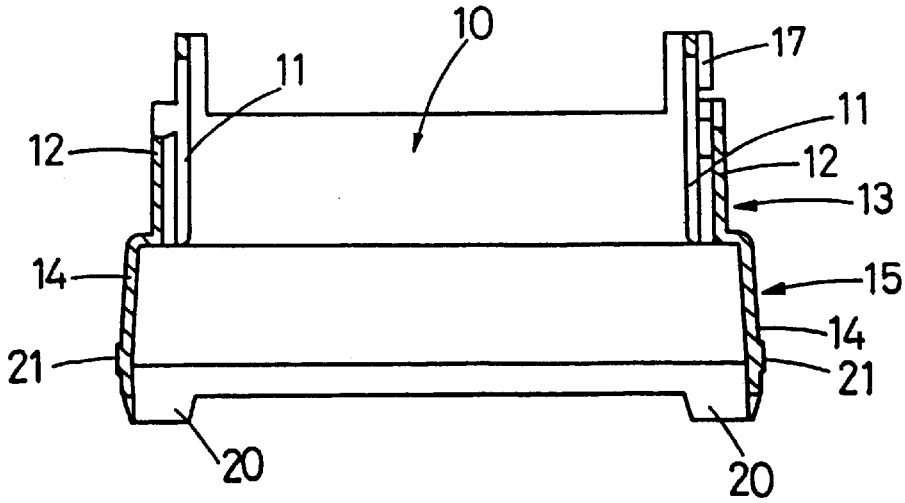
FIG. 4 is a cross sectional view of the skirt member.

Successively, the skirt member 2 is explained with reference to FIG. 1 to FIG. 4. FIG. 2 is a side view of the skirt member 2. FIG. 3 is an end face view of the same. FIG. 4 is a cross sectional view of the same. In those drawings, the skirt member 2 has an open cavity 10 which is substantially rectangular in a top view, an upper skirt portion 13 provided with an interior wall 11 defining the open cavity 10 in which the holder is slidably inserted and an exterior wall 12 formed in the outside of and integrally with the interior wall 11, and a lower skirt portion 15 provided with an exterior wall 14 formed with the bottom portion slightly widened continuously from the exterior walls 12.

On each end surface (right and left end faces in FIG. 2) of the upper skirt portion 13, there is formed a spring stopper 17 in an upper side of the interior wall 11. This spring stopper 17 serves to stop one end of a torsion spring 16 (see FIG. 1) whereby the holder 4 is always urged upward in the cavity 10. Obliquely below the spring stopper 17, a semicircular positioning projection 18 is formed (see FIG. 3). A coiled portion of the spring 16 is mounted around the projection 18 thereby to position the coiled portion. A vertical slot 19 is formed in the interior wall in the center. This slot 19 has an open lower end such that a sloped projection 35, which will be mentioned later, formed on either end surface of the holder 4 (see FIG. 5) is inserted in the slot 19 and slidable in a vertical direction. The vertical slot 19 serves to vertically guide the sloped projection 35 of the holder 4 in moving downward for stamping.

The lower skirt portion 15 is to be put on a printing sheet during the stamping operation, then supporting the entire stamp unit 1 on the printing sheet. The exterior wall 14 forming the lower skirt portion 15 has projections 20 formed on the lower corners respectively. With the support projections 20, the lower end of the exterior wall 14 of the lower skirt portion 15 is retained away from the printing sheet. It is to be noted that the exterior wall 14 is formed with an downward-arrow-shaped raised portion 21 located in each center of four surfaces of the wall 14 as shown in FIG. 2. This raised portion 21 indicates a stamping direction.

Figure 5:
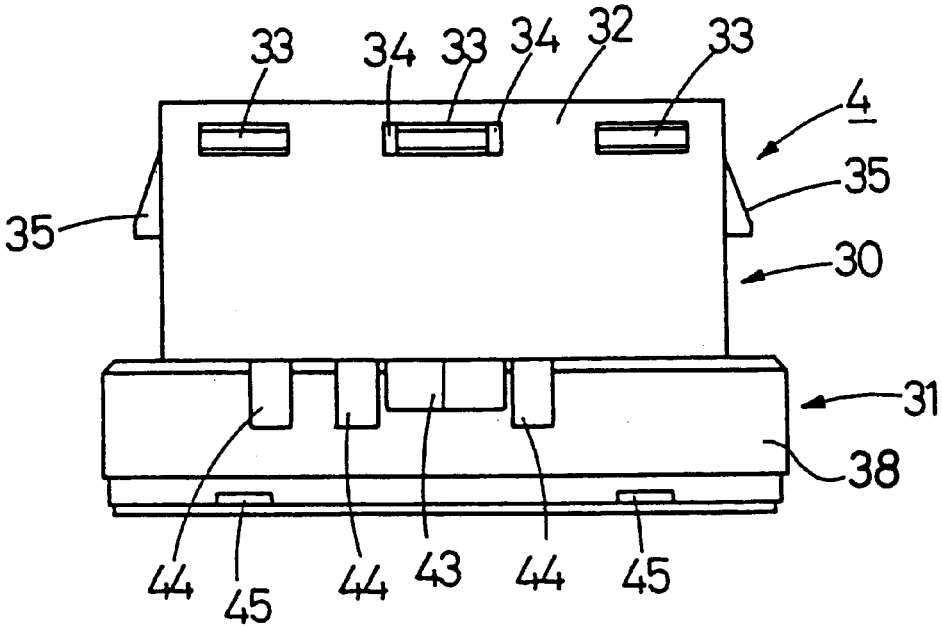
FIG. 5 is a side view of a holder in the embodiment.
Figure 6:
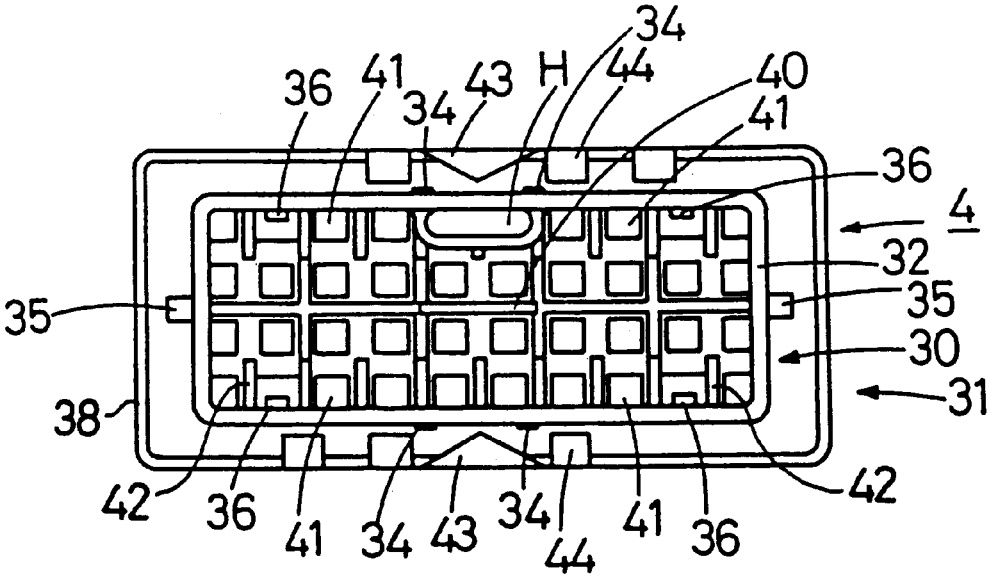
FIG. 6 is a plane view of the holder.
Figure 7:
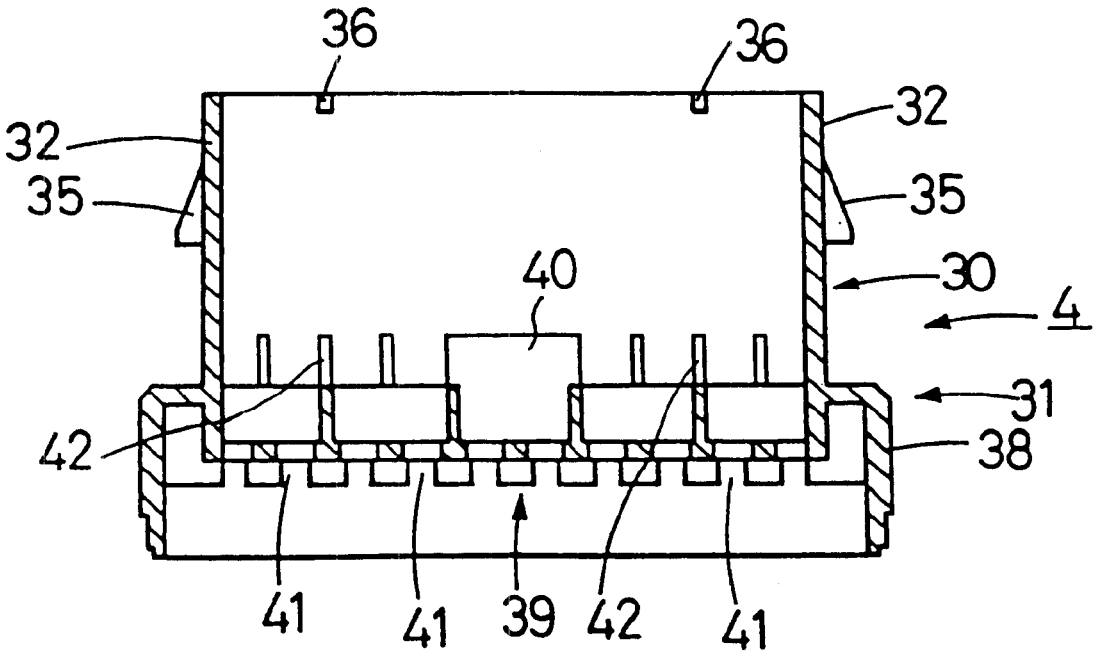
FIG. 7 is a sectional side view of the holder.

Next, description is made on the holder 4 with reference to FIGS. 5 to 7. FIG. 5 is a side view of the holder 4. FIG. 6 is a plane view of the same. FIG. 7 is a cross sectional view of the same. In those drawings, the holder 4 is constituted of an upper holder portion 30 and a lower holder portion 31, which are formed integrally and corresponding to the upper and lower skirt portions 13 and 15 respectively. The upper holder portion 30 has a peripheral wall 32 formed of an angular cylindrical body having a substantially rectangular cross section. On the upper side of front and rear wall portions (only one of them is shown in FIG. 5) of the cylindrical wall 32, there are formed three grooves 33 arranged horizontally and wedge-shaped restrictive projections 34 which slope downward from the outer surface of the wall 32 to the outside and disposed both sides of the center groove 33. Each of the grooves 33 is engaged with a rib protuberance 54 (mentioned later) of the grip member 5, such that the holder 4 is integrally connected with the grip member 5. The restrictive projections 34 come into contact with the upper end of the exterior wall 12 of the upper skirt portion 13 as the holder 4 is moved down for the stamping operation, and then serve to restrict the downward motion of the holder 4.

A wedge-shaped projection 35 formed sloping downward from the wall 32 to the outside is provided on either side surface (right and left side surfaces in FIG. 5) of the wall 32 of the upper holder portion 30. This sloped projection 35 is slidably inserted in the vertical slot 19 of the upper skirt portion 13 as the holder 4 is inserted into the skirt member 2 from its lower opening. One end of the torsion spring 16 traverses the slot 19 and is stopped in contact with the lower end of the projection 35 inserted in the slot 19, as shown in FIG. 1. Such the structure enables the vertical sliding of the holder 4 within the skirt member 2 by cooperation between the sloped projections 35 and the vertical slots 19. Another end of the torsion spring 16 is fixedly inserted in the spring stopper 17 of the upper skirt portion 13 while the opposite end of the spring 16 is stopped by the projection 35 as mentioned above, so that the holder 4 is always urged upward in the skirt member 2.

On each inside surface of the front and rear wall portions (upper and lower wall portions in FIG. 6) of the wall 32, there are provided two positioning projections 36 formed in a wedge-shape which slopes downward from the inside surface of the wall to the inside. The positioning projections 36 are to restrict the upward motion of a cardboard 37 arranged above the ink pack 6 housed in the holder 4 as shown in FIG. 1. With the positioning projections 36 formed on the upper side of the interior wall surface of the holder 4, the cardboard 37 can be held horizontally without inclining between the projections 36 and the ink pack 6. Accordingly, the cardboard 7, being held horizontally when the grip member 5 is pressed downward, can provide uniform pressure over the ink pack 6 sandwiched between the cardboard 37 and the bottom portion 39 of the holder 4. With the positioning projections 36 formed in a wedge shape sloping downward from the in wall surface of the holder 4 to the inside, the side ends of the cardboard 37 can be guided smoothly into the holder 4 due to the shape of the positioning projections 36 to dispose the cardboard 37 into the holder 4 from above. In this manner, the cardboard 37 can be readily attached to the inside of the holder 4.

The cardboard 37 is formed having the dimensions slightly larger than the inside dimensions of the holder 4. When the holder 4, while holding therein the ink pack 6, is moved downward by the depression of the grip member 5, as shown in FIG. 1, the cardboard 37 in cooperation with the positioning projection 36 exerts a substantially uniform pressure from the grip member 5 on the ink pack 6. Thus, the ink contained in the ink pack 6 is allowed to entirely flow downward and supplied to the stamp material 3. In this manner, the ink can be escaped from the ink pack 6 downward and supplied to the stamp material 3 without wastage of ink. When the cardboard 37 having the dimensions mentioned above is attached to the holder 4 above the ink pack 6 while the upward motion of the cardboard 37 is restricted by the positioning projections 36, the side edges of the cardboard 37 can be easily deformed to be smoothly arranged inside of the holder 4 and to be fixed at a predetermined position. Accordingly, the transportation and so on of the holder 4 holding therein the ink pack 6 is enabled. Furthermore, the cardboard 37 having the ink absorption ability as mentioned later will absorb the ink escaping from the ink pack 6 to the upper side thereof when the ink pack 6 is opened in the holder 4, and the leakage to the outside of the stamp unit 1 can be then prevented.

Note that an ink supply elongated hole H is formed on the interior wall surface of the front or rear wall of the wall 32 as shown in FIG. 6. This supply hole H is used for auxiliary supply of ink in case that the ink in the ink pack 6 is decreased. At this time, the ink is poured into the ink pack 6 through the ink supply hole H when the grip member 5 has been detached from the holder 4.

The lower holder portion 31 is formed integrally with the upper holder portion 30 and has a peripheral wall 38 with dimensions larger than the wall 32.

The upper holder portion 30 has a bottom portion 39 inside of the lower holder portion 31. The bottom portion 39 is configured of ribs in lattice form as shown in FIG. 6. A cutting rib 40 is provided at a substantial center position of the latticed bottom portion 39. A plurality of through holes 41 for ink distribution are provided around the cutting rib 40. The holder 4 including the cutting rib 40 is formed from ABS resin, polyolefine resin such as polyacetal copolymer, polypropylene, polyethylene, nylon, etc., PC resin, and the like. The cutting rib 40 presses the ink pack 6 against the cardboard 37 as the grip member 5 is pressed down, such that the part of the ink pack 6 caught between the cutting rib 40 and the cardboard 37 is broken and opened. To ensure the opening of the ink pack 6, the cutting rib 40 is formed having sharp-pointed corners. The through holes 41 are open opposite to the stamp material 3 as shown in FIG. 1 and guide the ink escaping from the ink pack 6 opened with the cutting rib 40 in the above-mentioned manner to flow downward. The ink is thus saturated into the stamp material 3. Support ribs 42 are integrally formed on the inner surface of the front and rear walls (upper and lower walls in FIG. 6) of the peripheral wall 32. The cutting rib 40 and the support ribs 42 are configured to have substantially the same height. Accordingly, an unopened ink pack 6 is prevented from slanting or gathering to one side in the holder 4, so that the ink pack 6 can be held in a substantial horizontal state in the inside of the holder 4. Upon open of the ink pack 6 with the cutting rib 40, the ink in the ink pack 6 is allowed to escape therefrom all at once. The space provided between the peripheral wall 32 and the cutting rib 40 serves to an ink storage part (which will be mentioned later; see FIG. 13) for the ink flowing out from the ink pack 6. Even if the ink flows out all at once from the opened ink pack 6, therefore, the ink is prevented from leaking to the outside of the holder 4.

A wedge-shaped slant recess 43, slanting inward, is provided at a substantial center position on each outer surface of the front and rear walls (upper and lower walls in FIG. 6) of the peripheral wall 38 constructing the lower holder portion 31. On both sides of the slant recess 43, one or two detection recesses 44 are formed, which act as an inactivation section while the wall 38 acts as an activation section. When a stamp is made from the stamp material 3 by means of the stamp manufacturing device which is disclosed in Japanese Patent Application No. 9-249983, the slant recess 43 serves to set the holder 4 to a predetermined stamp making position in the stamp manufacturing device. The number of the detection recesses 44 and their positions may be changed according to the size of the holder 4. The detection recesses 44 are used for specifying the type (size) of the holder 4 in cooperation with a microswitch 75A disposed on a fixing member 71 of a storage part 70, which will be mentioned later.

Figure 14:
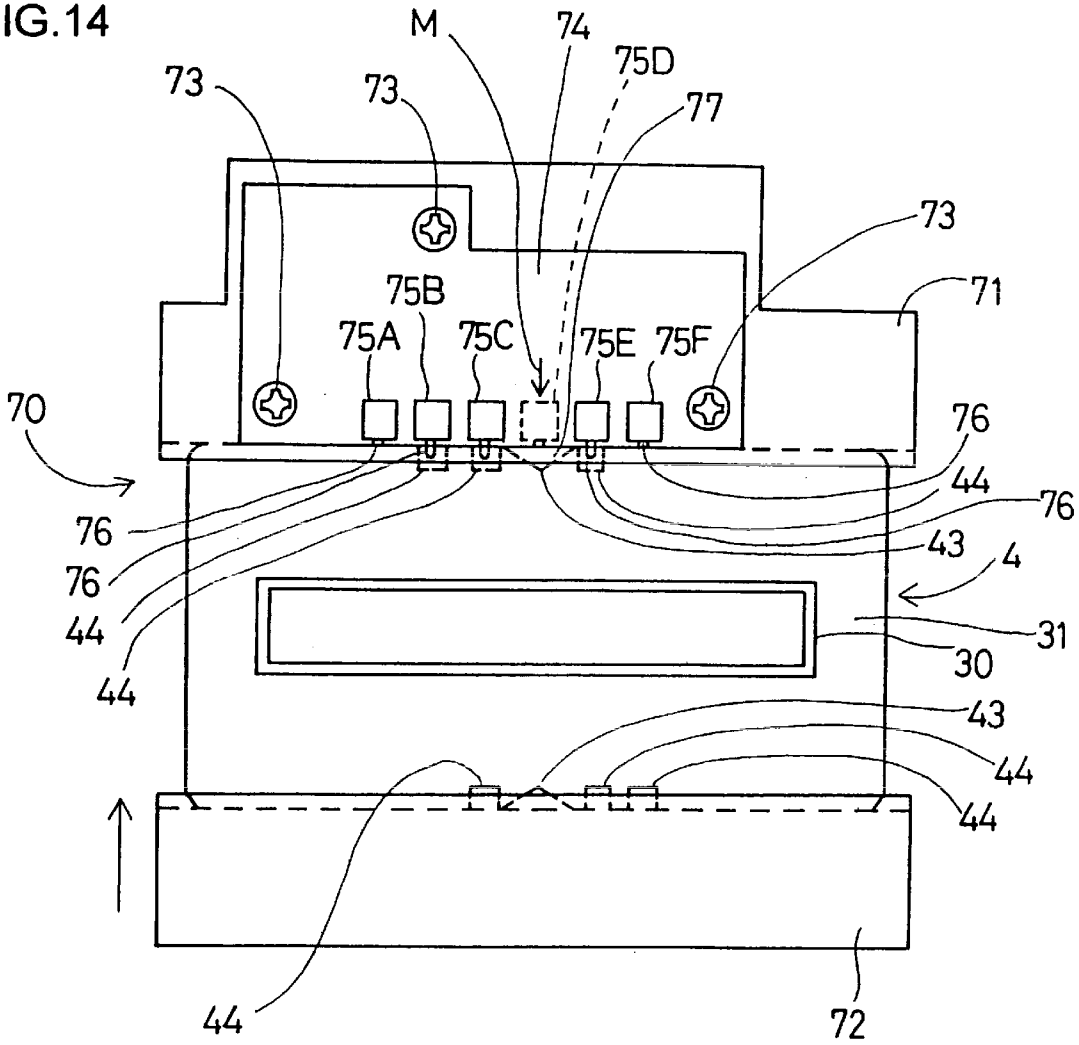
FIG. 14 is a plane view schematically showing a state where the holder is set to a predetermined stamp making position of the holder storage part in a stamp manufacturing device.
Figure 15:
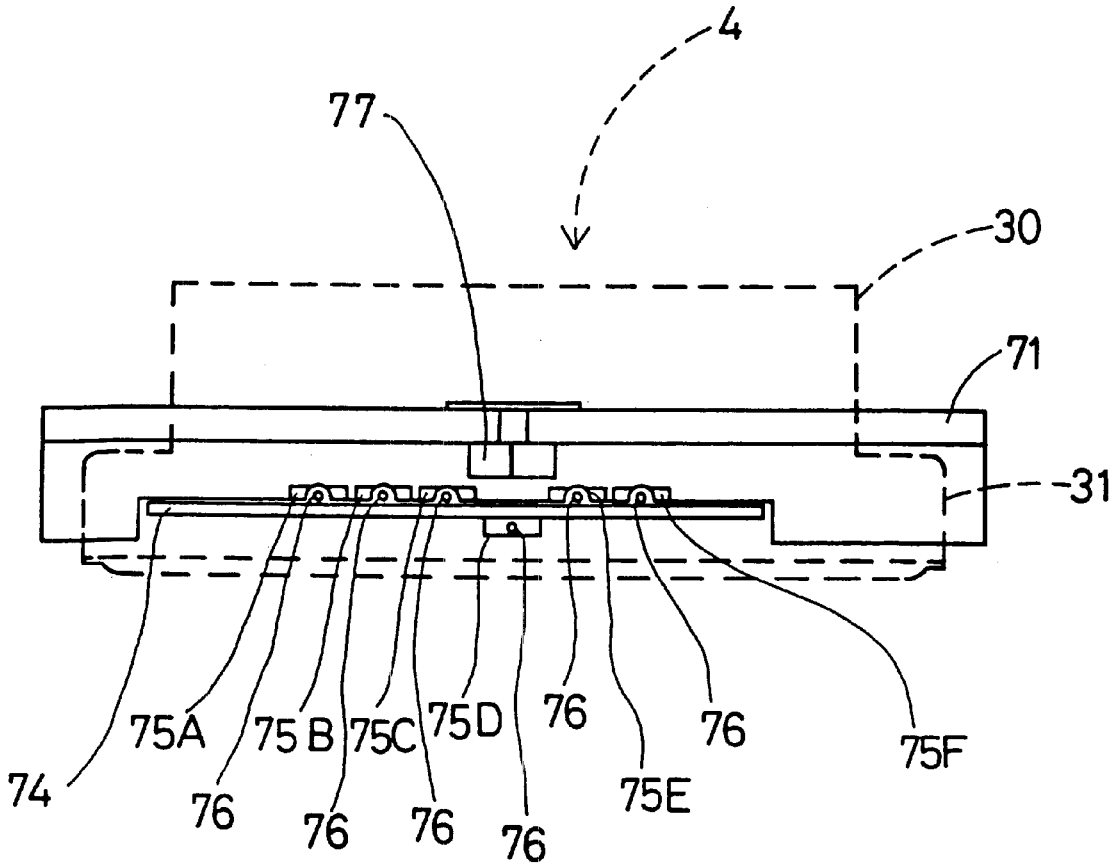
FIG. 15 is a side view schematically showing a state where the holder is set to a predetermined stamp making position of the holder storage part in a stamp manufacturing device.
Figure 16:
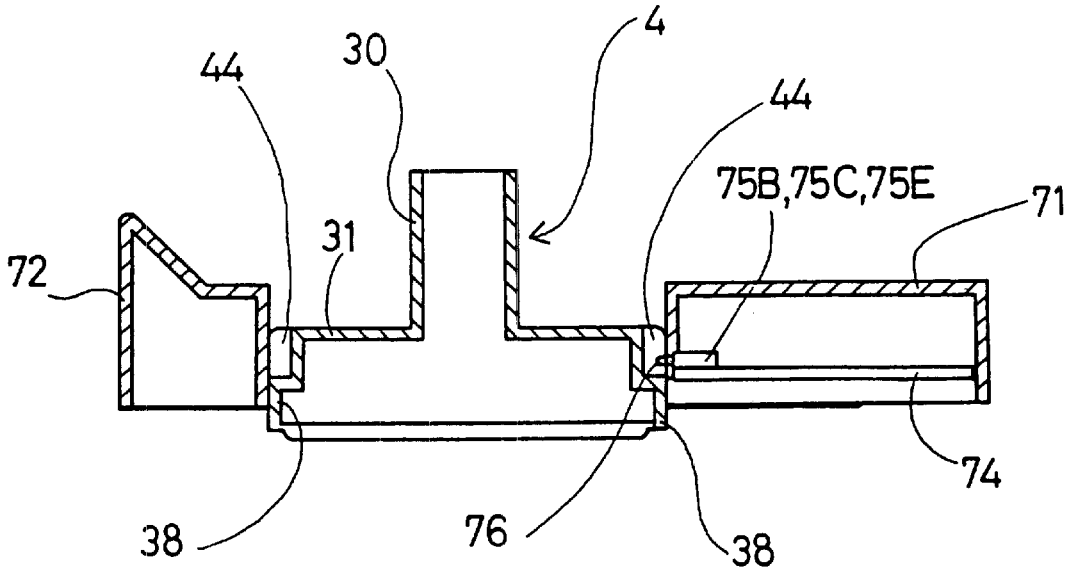
FIG. 16 is a cross sectional view schematically showing a state where the holder is set to a predetermined stamp making position of the holder storage part in a stamp manufacturing device.
Figure 17:
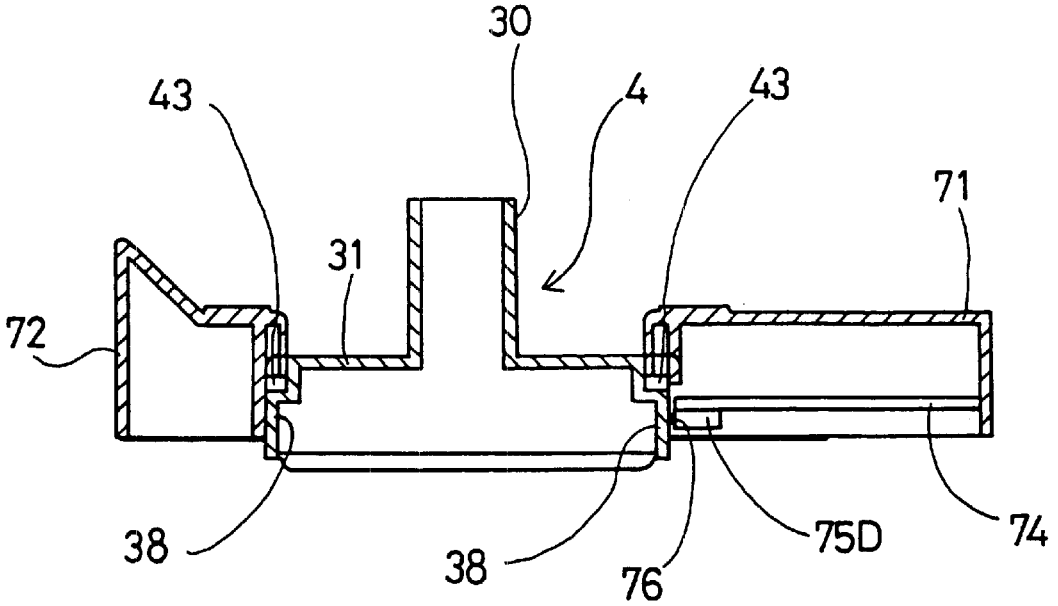
FIG. 17 is a cross sectional view schematically showing a state where the holder is set to a predetermined stamp making position of the holder storage part in a stamp manufacturing device.

Next, explanation is made on the actions of the slant recess 43 and the detection recess 44 when the holder 4 is placed at a predetermined stamp making position in the holder storage part of the stamp manufacturing device, referring to FIGS. 14 to 17. FIG. 14 is a plane view of schematically showing a state where the holder 4 is set to a predetermined stamp making position in the holder storage part. FIG. 15 is a side view schematically showing a state where the holder 4 is set to a predetermined stamp making position in the holder storage part. FIGS. 16 and 17 are cross sectional views schematically showing a state where the holder 4 is set to a predetermined stamp making position in the holder storage part.

In FIGS. 14 to 17, the holder storage part 70 in the stamp manufacturing device is provided with two holder fixing members 71 and 72 for holding and fixing the holder 4 therebetween. The fixing member 71 is fixedly provided in the holder storage part 70 and has a switch plate 74 secured with screws 73. On the upper surface of one side end of the switch plate 74, which is the side opposite to the peripheral wall 38 of the lower holder portion 31 of the holder 4, five microswitches 75A, 75B, 75C, 75E, and 75F are disposed in alignment. A switch terminal 76 of each of the microswitches 75A and others is disposed protruding toward the holder 4 side. The microswitches 75A and others are used for detecting the type of the holder 4 based on the combination of the on-off states of those microswitches caused by the holder 4 when set in the storage part 70.

A positioning projection 77 having the shape corresponding to the slant recess 43 of the holder 4 is formed on the side surface of the fixing member 71 at its substantial center position in the longitudinal direction. On the lower surface of the side end of the switch plate 74, in a position corresponding to the positioning projection 77, a microswitch 75D with a switch terminal 76 is disposed as shown in FIG. 15. This microswitch 75D is used for detecting the existence of the holder 4 based on the on-off state of the microswitch. It is to be noted that a set mark M shown in FIG. 14, which is an index for setting the holder 4 in the storage part 70, is provided on the upper surface of the fixing member 71, in a position corresponding to the positioning projection 77. The fixing member 72 is movable with respect to the fixing member 71 and urged by a spring not shown in the direction indicated by an arrow shown in FIG. 14.

Figure 18:
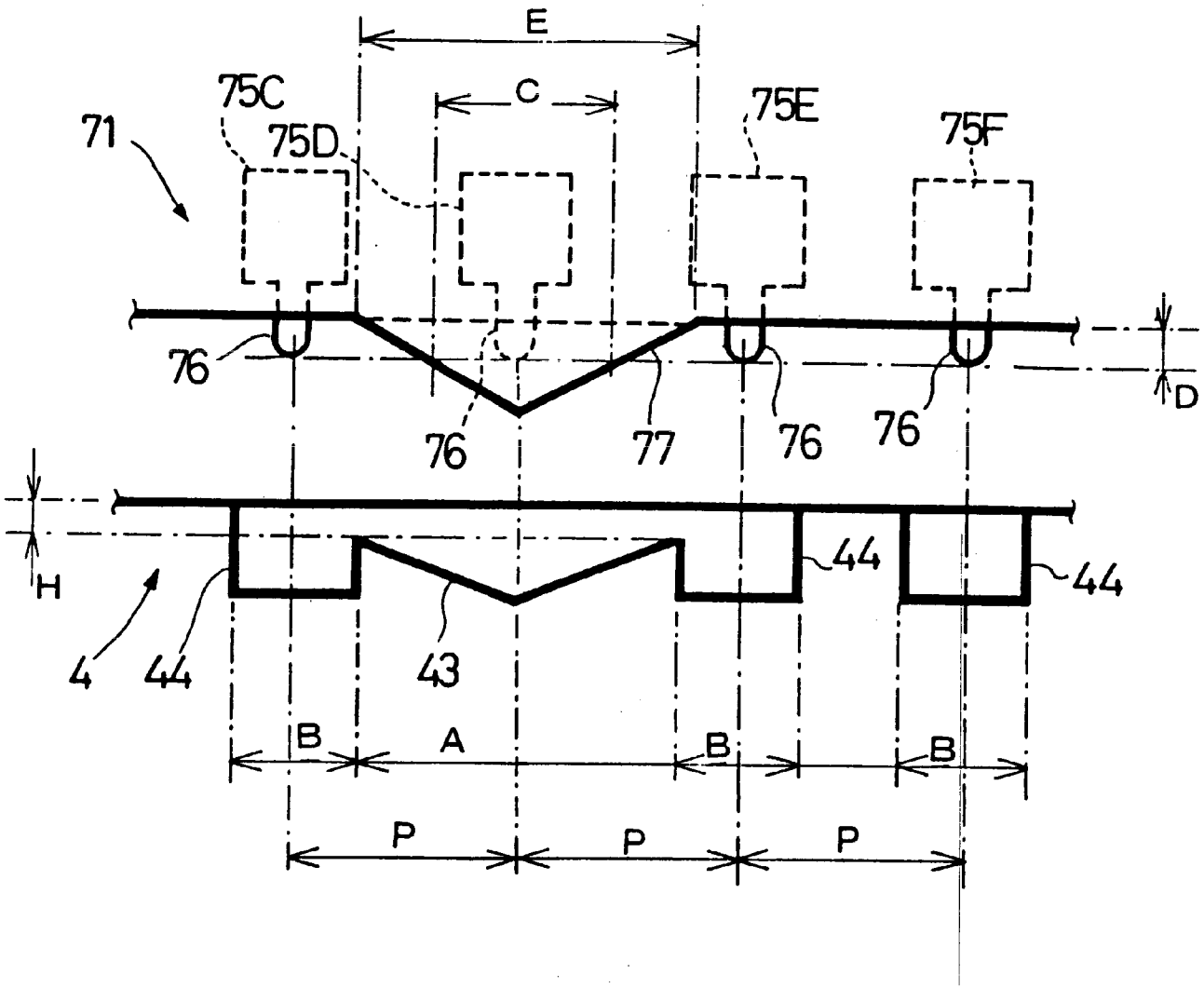
FIG. 18 is an explanatory view schematically showing the relationship in size among recesses and others.

The dimensional relation among the slant recess 43, the positioning projection 77, and the detection recess 44 is explained with reference to FIG. 18. FIG. 18 is an explanatory view of schematically showing the above dimensional relation.

In FIG. 18, the following relation is provided; "A" indicates the width of the slant recess 43; "B", the width of the detection recess 44; "C", the width between two intersect points determined by that an imaginary straight line passing through the tip of the terminal 76 of the microswitch 75D in parallel with the side edge of the fixing member 71 intersects two sloping surfaces of the positioning protrusion 77; "D", the distance of the switch terminal 76 protruding from the side edge; and "E", the width of the positioning projection 77. It is to be noted that "P" indicates a recess pitch between the slant recess 43 and the detection recesses 44, and "H" indicates the recessed amount of both side ends of the slant recess 43 from the side wall of the holder 4.

Among the width E of the positioning projection 77, the width A of the slant recess 43, the recess pitch P, and the width B of the detection recess 44, there exists the relationship defined by the following expression; $E \leqq A \leqq 2(P-B/2)$. Because of this relationship, even when the holder 4 is set in the storage part 70 while the slant recess 43 is out of engagement with the positioning projection 77, the cam effect between the projection 77 and the slant recess 43 causes the projection 77 to mate with the slant recess 43.

Thus, the switch terminal 76 surely enters in the corresponding detection recess 44.

Furthermore, between the recessed amount H of both side ends of the slant recess 43 and the protruding distance D of the switch terminal 76, the relationship defined by the following expression; H<D. According to such the relationship, the terminal 76 will not be turned on by the side ends of the slant recess 43, while the switch terminal 76 of the microswitch 75D can surely contact the peripheral wall 38 of the holder 4, and be turned on.

There exists the relation defined by the following expression; C≧B between the width C and the width B of the detection recess. Based on such the relation, the switch terminal 76 of the microswitch 75D is surely prevented from turning on even when the tip of the positioning projection 77 goes into the detection recess 44 by mistake.

To set the holder 4 to a predetermined stamp making position in the holder storage part 70 with the above structure, at first, the fixing member 72 is moved in the opposite direction to the arrow shown in FIG. 14 against the urging spring, thereby opening the holder storage part 70. Using the set mark M as a general index, the holder 4 is placed in the storage part 70 such that the substantially longitudinal center portion (where the slant recess 43 is formed) of the holder 4 is positioned in correspondence with the set mark M.

Since the slant recess 43 has both sides which are slanted to the inside of the holder 4, even if the holder 4 is put with its longitudinal center portion slightly deviated from the mark M, the holder 4 is caused to move such that the positioning projection 77 properly mates with the slant recess 43 due to the cam effect generated between the projection 77 of the fixing member 71 and the slant recess 43 of the holder 4. The holder 4 is then set to a predetermined stamp making position in the holder storage part 70 as shown in FIG. 14. In this position, as will be mentioned later, a stamping surface is formed on the lower surface side of the stamp material 3 held in the holder. 4.

As shown in FIG. 14, when the holder 4 is set in place in the holder storage part 70, the switch terminal 76 of the microswitch 75A contacts the outer surface of the peripheral wall 38 of the lower holder portion 31, while the switch terminals 76 of the microswitches 75B, 75C, and 75E enter in the detection recesses 44 as shown in FIG. 16. The switch terminal 76 of the microswitch 75F contacts the outer surface of the peripheral wall 38. In this state, the microswitches 75A and 75F are in an ON-state, the microswitches 75B, 75C, and 75E are in an OFF-state. Based on the combination of ON-OFF states of the microswitches, the type of the holder 4 is detected. The switch terminal 76 of the microswitch 75D, contacting the peripheral wall 38 of the lower holder portion 31 as shown in FIG. 17, is in an ON-state. Based on the ON-state of the microswitch 75D, the existence of the holder 4 in the storage part 70 is detected.

As shown in FIGS. 6 and 14, it is configured such that the positions of the slant recess 43 and the detection recess 44 formed on one wall surface of the peripheral wall 38 are in rotational symmetry with respect to the positions of the slant recess 43 and the detection recess 44 formed on another wall surface. This makes it possible to perform a stamp making process for the stamp material 3 even when the holder 4 is set by reversing the front and rear walls to the storage part 70 of the stamp manufacturing device.

At lower positions of the front and rear walls of the peripheral wall 38, as shown in FIG. 5, a pair of lugs 45 serving as a stopper are formed. The stopper 45 can be fitted in stopper recesses 62 of a cap 60 which will be mentioned later to attach the cap 60 to a lower end of the lower holder portion 31. Accordingly, the stamping surface of the stamp material 3 held at the lower end of the peripheral wall 38 is covered and protected by the cap 60.

The stamp material 3 is made from the same material as the stamping surface forming member disclosed in Japanese patent application No. 9-249983, and of the two-layer structure including an upper layer made of porous hard resin and a lower layer made of porous soft resin in which optical energy absorbing material such as carbon black, etc. are dispersively contained. To make a stamping surface on the stamp material 3, using the stamp manufacturing device disclosed in Japanese patent application No. 9-249983, at first, while a part of rolled-up transparent film is drawn out and fed from the roll, characters and figures are printed on the film to form a positive manuscript. This positive manuscript is fed onto a transparent acrylic plate. Subsequently, the holder 4 holding therein the stamp material 3 is set to a predetermined stamp making position in the above-mentioned manner such that the lower layer of the stamp material 3 faces the positive manuscript. In this state, when a xenon tube disposed below the transparent acrylic plate is driven to emit light, the lower layer of the stamp material 3 is irradiated with the light through the positive manuscript. Accordingly, only the part of the lower layer irradiated with the light at sites corresponding to the transparent portion of the manuscript is fused due to the heating effect of the optical absorbing material included in the lower layer, and the fused part is solidified. On the other hand, the part of the lower layer corresponding to the characters and the like on the manuscript remains as it is without being fused-solidified, thus forming a stamping surface on the underside of the stamp material 3.

Figure 8:
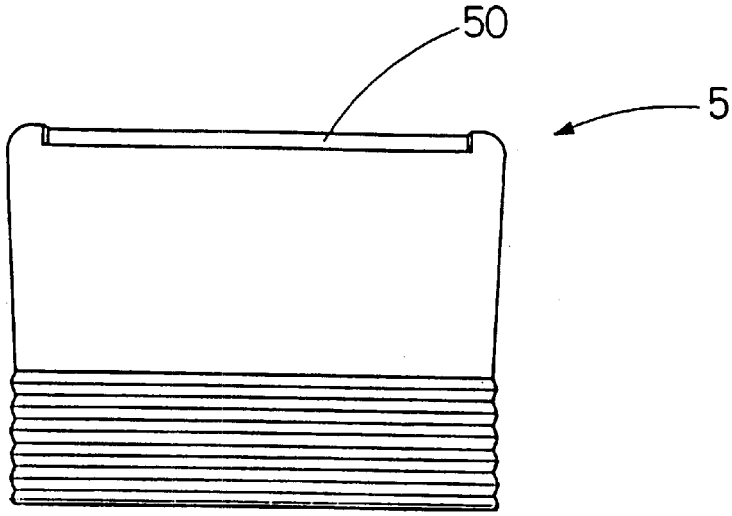
FIG. 8 is a side view of a grip member in the embodiment.
Figure 9:
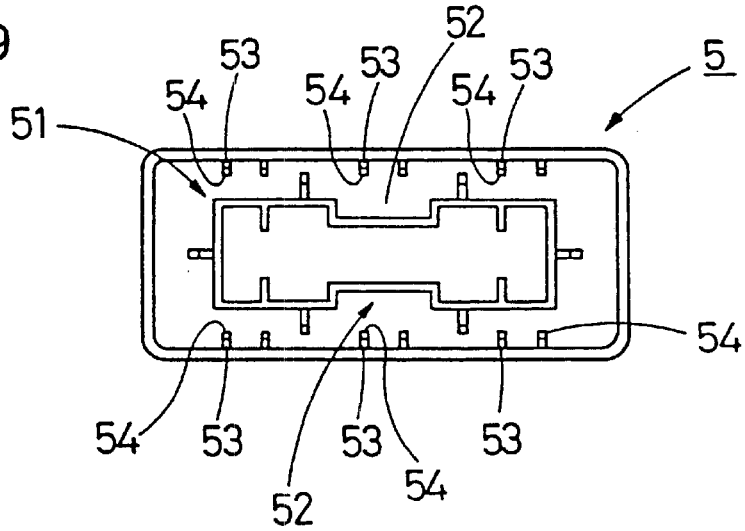
FIG. 9 is a bottom view of the grip member.
Figure 10:
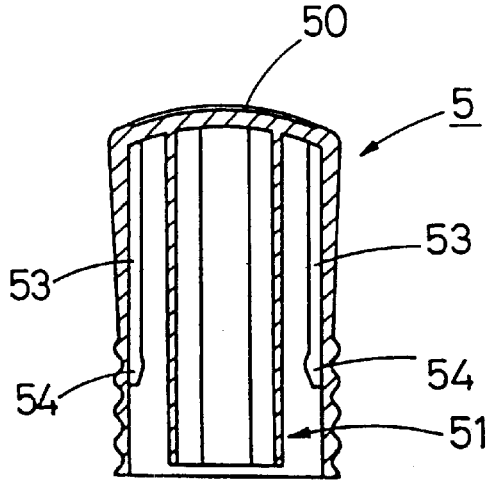
FIG. 10 is a cross sectional view of the grip member taken along the short width direction thereof.

Next, the grip member 5 is described with reference to FIG. 1, and FIG. 8 to FIG. 10. FIG. 8 is a side view of the grip member 5. FIG. 9 is a bottom view of the grip member 5. FIG. 10 is cross sectional view of the grip member 5 taken in a shorter width direction.

In those drawings, the grip member 5 is provided, on its upper surface, with a labeling portion 50 to which a label and the like for indicating the content of the stamping surface formed on the material 3 is attached. Inside of the grip member 5, as shown in FIGS. 1, 9, and 10, there is provided a press portion 51 to be inserted in the peripheral wall 32 of the upper holder portion 30 of the holder 4. The press portion 51 presses the ink pack 6 disposed in the holder 4 through the cardboard 37. The press portion 51, of which the bottom is viewed in FIG. 9, has a substantially rectangular shape with concave portions 52 disposed in the center of either side and opposite to each other. The concave portion 52 is to allow the wall defining the ink supply hole H disposed on one wall surface of the peripheral wall 32 to be inserted when the press portion 51 of the grip member 5 is inserted in the peripheral wall 32 of the holder 4. The reason that the pair of the concave portions 52 are formed is to prevent the wall defining the ink supply hole H from becoming obstacle no matter how the press portion 51 of the grip member 5 is inserted in the peripheral wall 32. On the inner wall surface of the grip member 5, there are provided a plurality of ribs (six ribs in FIG. 9) disposed extending in a vertical direction as shown in FIG. 10. A protuberance 54 is integrally formed on a lower side of the rib 53. The protuberance 54 is to be fitted in the groove 33 formed on the peripheral wall 32 in the external upper part thereof, thereby integrally connecting the holder 4 to the grip member 5.

Figure 11:
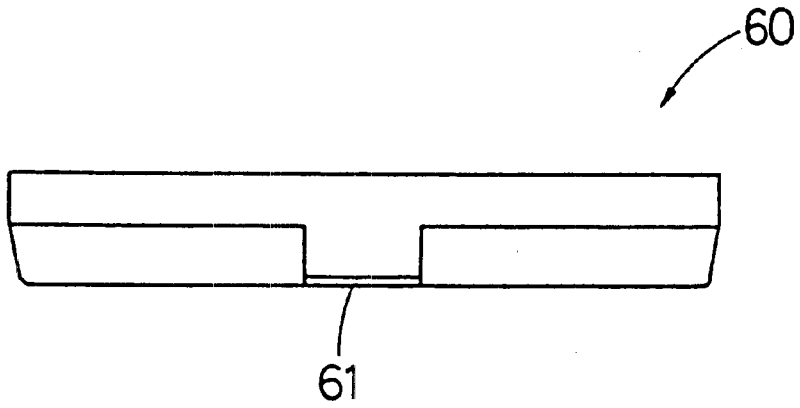
FIG. 11 is a side view of a cap member in the embodiment.
Figure 12:
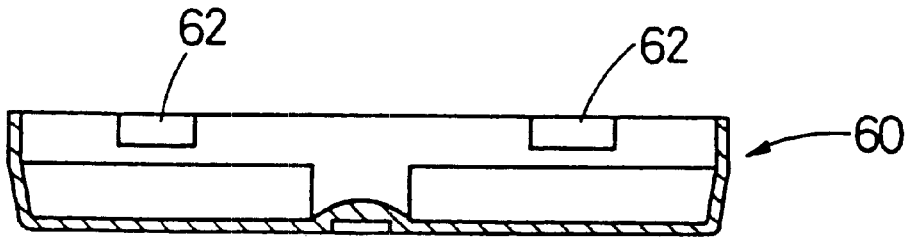
FIG. 12 is a cross sectional view of the cap member.

Next, description is made on a cap to be attached to the lower end of the lower holder portion 31 of the holder 4, referring to FIGS. 11 and 12. FIG. 11 is a side view of the cap. FIG. 12 is a cross sectional view of the cap. The cap 60 has an open box-like shape and provided, on both side walls, with holding parts 61 which can be held by user's fingers for attachment or detachment of the cap 60 to or from the holder 4. On the both inwall side surfaces of the cap 60, there are provided a pair of stopper recesses 62 with which the pair of the stopper lugs 45 formed on the peripheral wall 38 are to be engaged. By the engagement between the stopper recesses 62 of the cap 60 and the stopper lugs 45 of the peripheral wall 38, the cap 60 is attached to the holder 4. Therefore, the stamping surface of the stamp material 3 held inside the peripheral wall 38 of the holder 4 is covered and protected by the cap 60.

The process of producing the stamp unit 1 mentioned above is as follows. At first, to make a stamping surface in the underside of the stamp material 3, the holder 4 is set to the predetermined position in the holder storage part 70 of the stamp manufacturing device (see FIGS. 14 to 17). This holder 4 is retaining the stamp material 3 in the lower end part, the ink pack 6 in the inside, and the cardboard 37 disposed above the ink pack 6 and restricted by the positioning projections 36. Based on the cam effect between the slant surfaces of the slant recess 43 of the lower holder portion 31 and the positioning projection 77 of the fixing member 71, the holder 4 is allowed to be positioned at a predetermined stamp making position in the storage part 70 of the stamp manufacturing device. In this position, the terminal 76 of the microswitch 75D of the fixing member 71 contacts the peripheral wall 38, whereby the existence of the holder 4 in the holder storage part 70 is detected. Based on the number and the positions of the detection recesses 44, namely, based on the combination of the ON-OFF states of the microswitches 75A to 75C, 75E, and 75F disposed on the fixing member 71, the type (size) of the holder 4 is detected.

It is to be noted that the cardboard 37 is disposed above the ink pack 6 and the upward motion of the cardboard 37 is restricted by the positioning projections 36, so that the ink pack 6 can be fixed to some extent in the holder 4. There is no problem at all, even if the transportation of the holder 4 is carried out in the condition that the ink pack 6 is placed in the holder. Since the cutting rib 40 and the support rib 42 has substantially the same height, then preventing the unopened ink pack 6 from slanting or gathering to one side, the ink pack 6 can be held in the holder 4 in a substantially horizontal position.

In the stamp manufacturing device, prior to the setting of the holder 4 holding the stamp material 3 to a predetermined stamp making position of the storage part 70, a part of rolled-up transparent film is drawn out and fed from the roll, and characters and figures are printed on the film to form a positive manuscript. This positive manuscript is fed onto a transparent acrylic plate. Subsequently, the holder 4 is set to a predetermined stamp making position such that the lower layer of the stamp material 3 is opposite to the manuscript. In this state, when a xenon tube disposed below the transparent acrylic plate is driven to emit light, the lower layer of the stamp material 3 is irradiated with the light through the positive manuscript. As a result, only the part of the lower layer irradiated with light at sites corresponding to the transparent portion of the manuscript is fused due to heating effect of the optical absorbing material of the lower layer, and solidified. On the other hand, the part of the lower layer corresponding to the characters and the like on the manuscript is not fused-solidified and remains as it is, thus forming a stamping surface on the underside of the stamp material 3.

Upon completion of the stamp making of the stamp material 3, the holder 4 is inserted in the open cavity 10 of the skirt member 2 under the condition that, on each side surface of the upper skirt portion 13, the coiled portion of the spring 16 is previously positioned around the positioning projection 18 while the one end of the spring 16 is fixedly inserted in the stopper 17. The sloped projection 35 formed on each side surface of the peripheral wall 32 of the upper holder portion 30 of the holder 4 inserted from the lower open end of the skirt member 2 is allowed to slide upward in the vertical slot 19. When the sloped projection 35 goes over the other end of the torsion spring 16 according to the wedge shape of the projection 35, the end of the torsion spring 16 is stopped in contact with the lower end of the projection 35. The holder 4 in this position is urged upward in the skirt member 2 by the urging force of the torsion spring 16, while the holder 4 is also slidable downward against the urging force of the spring 16.

After assembly of the holder 4 to the skirt member 2 as mentioned above, the grip member 5 is attached to the holder 4 such that the press portion 51 is inserted in the peripheral wall 32 of the holder 4. This assembled state is shown in FIG. 1. When the grip 5 in the state that the press portion 51 is inserted in the peripheral wall 32 is further pressed down, the ink pack 6 in the holder 4 is sandwiched and pressed between the cardboard 37 and the cutting rib 40. At this time, due to the action of the cardboard 37, the pressing force substantially uniformly exerts on the ink pack 6. The ink pack 6 is then broken at the portion contacting the cutting rib 40 and opened at the substantial center portion corresponding to the position of the cutting rib 40. The ink flowing out from the ink pack 6 can be dispersed uniformly around the rib 40. The cardboard 37 having the ink absorption ability absorbs the ink escaping from the opened ink pack 6 to the upper side when the ink pack 6 in the holder 4 is opened by the down movement of the grip member 5, thereby to prevent the leakage of the ink to the outside of the stamp unit 1. This state is shown in FIG. 13.

Figure 13:
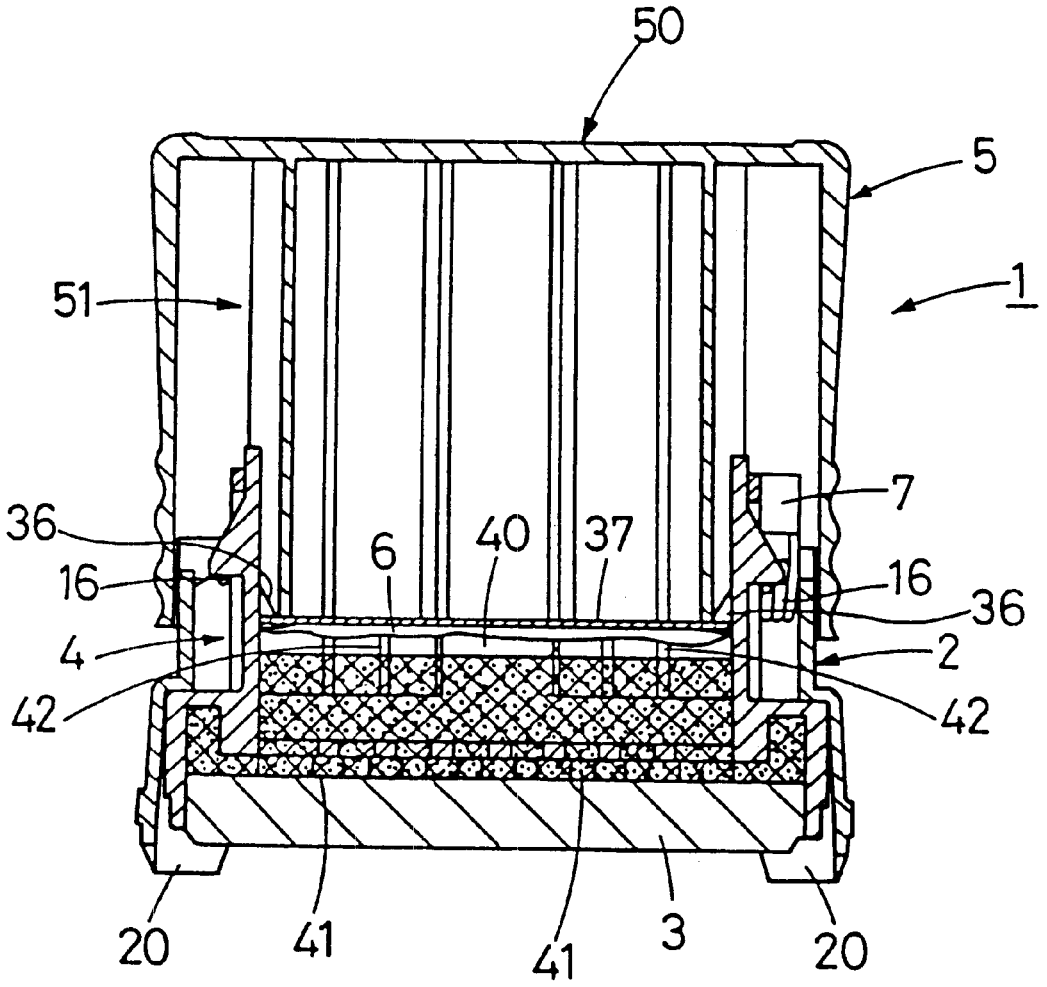
FIG. 13 is a cross sectional view of the stamp unit after ink supply.

Because the space provided between the peripheral wall 32 and the cutting rib 40 becomes an ink storing portion for the ink escaping from the opened ink pack 6 as shown in FIG. 13, the ink is prevented from leaking to the outside of the holder 4 even if the ink escapes all at once from the ink pack 6 opened with the cutting rib 40.

The ink escaping from the ink pack 6 is guided downward through the through holes 41 formed around the cutting rib 40, and then saturated into the stamp material 3. Since the through holes 41 disposed around the cutting rib 40, the ink escaping from the ink pack 6 is dispersed uniformly over the entire bottom of the holder 4, resulting in the uniform saturation of the stamp material 3 with ink.

When the ink pack 6 is opened by the downward movement of the grip member 5 in the above-mentioned manner, the protuberance 54 formed in the lower side of each of the ribs 53 of the grip member 5 is engaged with the groove 33 formed on the peripheral wall 32 of the holder 4, so that the holder 4 is integrally connected to the grip member 5. As the grip member 5 and the holder 4 are integrally moved, therefore, the stamping operation is performed to stamp characters and the like corresponding to the stamping surface formed on the stamp material 3 saturated with ink as above.

In the case that the ink saturated in the stamp material 3 decreases, disabling stamping with proper ink thickness, the following operation is carried out; the grip member 5 is detached from the holder 4, and the cardboard 37 and the ink pack 6 that there is no ink are taken out from the holder 4, and the ink-filled new pack 6 is inserted in the holder 4 and the grip member is attached again to the holder 4 as mentioned above. Thus, the stamp operation is enabled again. Without taking out the ink pack 6 and the cardboard 37, alternatively, the ink supply may be performed through the ink supply hole H formed on an inwall surface of the peripheral wall 32 of the holder 4 in order to enable the stamping operation again.

In the stamp unit 1 in the present embodiment, as described above, to supply ink to the stamp material 3, the grip member 5 is pressed down with respect to the holder 4, thereby pressure-sandwiching the ink pack 6 between the cardboard 37 and the cutting rib 40 in the holder 4, and opening the ink pack 6. The ink in the thus opened ink pack 6 is allowed to escape therefrom and flow downward through the through holes 41 into the stamp material 3. The supply of ink to the stamp material 3 can be thus carried out by the one-touch simple operation mentioned above.

If the ink saturated in the stamp material 3 decreases after the repetition of stamping of characters and the like, resulting in the lowering of the thickness of ink forming stamped characters, the ink supply to the stamp material 3 can be made by a simple operation of replacing the used ink pack 6 with a new one. The stamping operation is then enabled again.

Since the holder 4 is provided with the cutting rib 40 which will contact the ink pack 6 and the through holes 41 opposite to the stamp material 3, the ink pack 6 held in the holder 4 can be readily opened with the cutting rib 40 and the ink escaping from the opened ink pack 6 can be rapidly saturated into the stamp material 3 through the through holes 41.

The ink escaping from the opened ink pack 6 is allowed to flow downward through the through holes 41 arranged around the cutting rib 40 into the stamp material 3. At this time, the arrangement of the through holes 41 causes uniform dispersion of the ink from the ink pack 6 over the whole bottom of the holder 4, so that the ink can be uniformly saturated into the whole stamp material 3.

Because the cutting rib 40 and the support rib 42 have substantially the same height, the unopened ink pack 6 can be held in the holder 4 in a substantially horizontal position without slanting or gathering to one side. Accordingly, the ink escaping from the ink pack 6 when opened is dispersed uniformly over the whole bottom of the holder 4 without partially collecting in the holder 4, resulting in the uniform saturation in the stamp material 3.

Although the ink will escape all at once from the ink pack 6 when opened with the cutting rib 40, the space formed between the peripheral wall 32 and the cutting rib 40 provides the ink storage portion for the ink escaping from the ink pack 6 as shown in FIG. 13, and prevents the leakage of the ink to the outside of the holder 4.

The pressing force exerting on the ink pack 6 as the grip member 5 is moved down is substantially uniform due to the cardboard 37. The ink pack 6 is thus broken and opened at the substantially center portion contacting the cutting rib 40 and opened. Therefore, the ink escaping from the opened ink pack 6 can be uniformly dispersed around the cutting rib 40. Having the ink absorption ability, the cardboard 37 absorbs the ink escaping from the ink pack 6 opened in the holder 4 by the downward movement of the grip member 5 as mentioned above to the upper side of the ink pack 6, thereby preventing the leakage of the ink to the outside of the stamp unit 1.

Since the positioning projections 36 are provided on the inwall upper part of the holder 4, the cardboard 37 can be held in a horizontal state between the positioning projections 36 and the ink pack 6. Because of such the cardboard 37 held in a horizontal position, the ink pack 6 can be uniformly pressure-sandwiched between the cardboard 37 and the bottom portion 39 of the holder 4 while the grip member 5 is moved down. Due to the wedge-shaped positioning projection 36 which slopes downward from the holder inwall surface to the inside, the side edges of the cardboard 37 are smoothly guided along the shape of the projections 36 from above into the holder 4, so that the cardboard 37 can be easily attached to the holder 4.

The cardboard 37, having the dimensions slightly larger than the inner size of the holder 4, can be readily placed above the ink pack 6, as the side edges can be easily deformed to be inserted in the holder 4. The cardboard 37 can be also fixed at a desired position inside of the holder 4. Accordingly, the holder 4 can be transported while the ink pack 6 is retained therein.

In the stamp unit 1 mentioned above, when the holder 4 is set in the holder storage part 70 of the stamp manufacturing device, the cam effect is generated between the positioning projection 77 of the fixing member 71 and the slant surface of the slant recess 43 of the holder 4. By this cam effect, the projection 77 is guided into the slant recess 43, positioning the holder 4 in the storage part 70. When the holder 4 is positioned in place in the storage part 70 by cooperation between the projection 77 and the recess 43, the microswitch 75A and others placed in the neighborhood of the projection 77 of the storage part 70 are selectively turned on and off according to the peripheral wall 38 and the detection recesses 44 provided in the neighborhood of the slant recess 43 of the holder 4. According to the selective ON-OFF state of the microswitches 75A and others, the existence and the type (size) of the holder 4 used for the stamp unit 1 are detected.

Therefore, even when the holder 4 is carelessly placed in the holder storage part 70, the positioning projection 77 is guided into the slant recess 43 due to the cam effect, easily ensuring the setting of the holder 4 to a predetermined position in the storage part 70. The microswitches 75A and others are selectively turned on and off through the detection recesses 44 and the peripheral wall 38 provided in the neighborhood of the slant recess 43 of the holder 4 set to the predetermined position, so that the existence and the type of the holder used in the stamp unit 1 can be surely detected.

In the stamp unit 1 in the embodiment, the slant recess 43 and the detection recesses 44 of the holder 4 are rotational-symmetrically disposed in both side walls of the holder 4. Therefore, the holder 4 can be set in the holder storage part 70 from either direction, without the necessity for a user to take notice of the set direction of the holder especially.

Since the holder 4 itself which holds the stamp material 3 is set in the stamp manufacturing device to make a stamp, the stamp manufacturing device can be reduced in size as compared with the case that the whole stamp unit 1 has to be set in the device. Because the holder 4 holding the stamp material 3 is directly subjected to the stamp manufacturing process, the slant recess 43 and the detection recesses 44 are formed in the holder 4. Accordingly, there is no necessity of forming a positioning recess or the like in the skirt member 2. The holder 4, which is disposed inside of the skirt member, is invisible from the outside, so that the appearance of the stamp unit 1 may be maintained.

As the occupation space of the torsion spring 16 is small, no special space is required to be provided between the skirt member 2 and the holder 4 for disposing the torsion spring 16 therebetween. In each of the both end surfaces of the skirt member 2, the vertical slot 19 with an opened lower end is formed for guiding the sloped projection 35 when the holder 4 is inserted into the skirt member 2 from below, so that assembling of the holder 4 to the skirt member 2 can be facilitated. The sloped projection 35, formed in a wedge form which slopes downward from the wall surface of the holder 4 to the outside, is moved upward in the vertical slot 19 as the holder 4 is inserted in the skirt member 2 and goes over the end of the torsion spring 16 according to the wedge shape of the projection until the lower end thereof contacts the end of the spring 16. A simple operation of inserting the holder 4 into the skirt member 2 from below can automatically stop the end of the torsion spring 16 by the lower end of the sloped projection 35. Owing to the positioning projection 18 formed on each of the end surfaces of the skirt member 2, the torsion spring 16 can be held in advance in place, achieving the prevention of the loss of the spring 16.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A stamp unit utilizable in a stamp manufacturing device with a storage part where detection switches are arranged, comprising:

a holder member disposed vertically slidably;

a stamp member held at a lower end of the holder member;

a grip member disposed above the holder member, for moving the holder member downward;

a positioning projection formed in the storage part where the detection switches detect the holder member set therein;

a positioning recess formed, in a substantially center position of the side wall of the holder member, in an inward wedged shape with two flat surfaces sloping toward an inside of the holder member, the two sloped surfaces providing a cam member and a cam effect in cooperation with the positioning projection, and the positioning recess positioning the holder member in the storage part due to the cam effect; and activation and inactivation sections formed in the holder member close to the positioning recess, the sections causing the detection switches to selectively turn on or off in a state that the holder member is positioned in the storage part by the positioning recess.

2. The stamp unit according to claim 1, wherein the holder member has both side walls, and the positioning recess and both the activation and inactivation sections are formed on both side walls of the holder member, one of the side walls facing to the positioning projection and the detection switches when the holder member is set in the storage part, such that the positioning recess and the activation and inactivation sections formed on one of the side walls of the holder member are in rotational-symmetrical relation with those formed on another side wall.

3. The stamp unit according to claim 1, the inactivation section further comprising a detection recess formed on the side wall of the holder member, the detection recess corresponding to the detection switch.

4. The stamp unit according to claim 3, further comprising the positioning recess and the detection recess formed on the side wall of the holder member at a predetermined arrangement pitch P.

5. The stamp unit according to claim 1, further comprising a skirt member in which the holder member is disposed vertically slidably.

* * * * *